US012534911B2

(12) United States Patent
Wang

(10) Patent No.: US 12,534,911 B2
(45) Date of Patent: Jan. 27, 2026

(54) DOUBLE-SEPARATING AND DOUBLE-PULLING ZIPPER, PARTITION STRUCTURE AND CLOTHING

(71) Applicant: Hui-Min Wang, New Taipei (TW)

(72) Inventor: Hui-Min Wang, New Taipei (TW)

( * ) Notice: Subject to any disclaimer, the term of this patent is extended or adjusted under 35 U.S.C. 154(b) by 350 days.

(21) Appl. No.: 18/363,684

(22) Filed: Aug. 1, 2023

(65) Prior Publication Data

US 2025/0003214 A1 Jan. 2, 2025

(30) Foreign Application Priority Data

Jun. 27, 2023 (TW) ..... 112123918

(51) Int. Cl.
*E04B 2/74* (2006.01)
*A44B 19/38* (2006.01)

(52) U.S. Cl.
CPC ..... *E04B 2/7427* (2013.01); *A44B 19/382* (2013.01)

(58) Field of Classification Search
CPC ..... E04B 2/7427; E04B 2/74; A44B 19/382; A44B 19/36; A44B 19/28; A44B 19/386; A44B 19/60; A44B 19/26; A45C 13/103; A47G 5/00
See application file for complete search history.

(56) References Cited

U.S. PATENT DOCUMENTS 2,553,230 A * 5/1951 Bashover ..... A44B 19/382 24/436
3,583,466 A * 6/1971 Dreyer ..... G03B 21/58 160/381
4,085,789 A * 4/1978 Steiner ..... A47G 5/00 160/351
4,842,035 A * 6/1989 Thompson ..... E04B 2/7431 160/351
5,414,950 A * 5/1995 Johnson, Sr. ..... E04H 15/001 135/901
6,068,556 A * 5/2000 Bernstein ..... A63J 1/02 472/79
6,206,079 B1 * 3/2001 Selgrad ..... G09F 15/00 160/351
6,253,509 B1 * 7/2001 Hellwig ..... E04B 2/7422 52/239
7,866,074 B2 * 1/2011 McComb ..... B43L 1/045 40/606.01

(Continued)

*Primary Examiner* — Beth A Stephan
(74) *Attorney, Agent, or Firm* — Leong C. Lei

(57) ABSTRACT

The present invention provides a double-separating and double-pulling zipper comprising a left tape extension, a right tape extension, a first slider, a second slider, two zipper teeth row. The two zipper teeth row are respectively arranged on the inner edges of the left tape extension and the right tape extension. The first slider and the second slider are slidably arranged on the two zipper teeth row, and the first slider and the second slider are pulled so that the left tape extension and the right tape extension are opened or closed. Therefore, the zipper of the present invention can be opened and closed in a two-way manner, making it applicable to partition structures to achieve the effect of space separation. Further, the zipper made of plastic materials can be applied to patient gowns, allowing patients to undergo MRI examinations directly while maintaining their self-esteem during various examinations.

1 Claim, 7 Drawing Sheets

(56) References Cited

U.S. PATENT DOCUMENTS

| | | | | |
|---|---|---|---|---|
| 11,877,629 | B1 * | 1/2024 | Chung | A44B 19/388 |
| 2003/0182872 | A1 * | 10/2003 | Gresham | E04B 2/7422<br>52/36.1 |
| 2012/0167354 | A1 * | 7/2012 | Keyaki | A44B 19/388<br>24/386 |
| 2012/0260468 | A1 * | 10/2012 | Nozaki | A44B 19/28<br>24/386 |
| 2013/0209727 | A1 * | 8/2013 | Orr | A44B 19/24<br>24/387 |
| 2014/0020217 | A1 * | 1/2014 | Kojima | A44B 19/36<br>24/436 |
| 2021/0282510 | A1 * | 9/2021 | McHugh | A44B 19/382 |

* cited by examiner

DOUBLE-SEPARATING AND DOUBLE-PULLING ZIPPER, PARTITION STRUCTURE AND CLOTHING

TECHNICAL FIELD OF THE INVENTION

The present invention relates to a multifunctional zipper, and more particularly to a multifunctional zipper with two zipper sliders that can be opened and closed in a two-way manner, which can be applied to partition structures or clothing, and so on.

DESCRIPTION OF THE PRIOR ART

The traditional zippers basically sew two rows of teeth on the opposite inner edges of a pair of zipper tapes, and a slider which can slide freely is mounted on two rows of teeth, so that the two rows of teeth can be attached or detached from each other to open and close the zipper smoothly. However, the zippers currently in use can only be opened or closed in a one-way manner, limiting their versatility and causing inconvenience to users in other aspects of usage. In zippers applied between two partitions of an office cubicle, when electrical appliances are installed in the office cubicle, it is important to pay attention to the installation of the wires. However, the existing zippers applied between two partitions of the office cubicle can only be opened or closed in a one-way manner, and the wires can only be installed either on the top of the partitions or on the ground. This complicates the installation of electrical wiring in the office cubicle.

In daily life, the design and application of zippers are very common in clothing, such as dresses, skirts, leather, coats, jackets, and so forth. However, the zippers on patient gowns are different from those on ordinary clothing and require special design. In nursing care and medical facilities, the patient gown worn by people who are bedridden due to illness, disability, the elderly, etc. need to be designed in a way that facilitates easy changing for diagnosis, treatment, or excretion management. The general patient gown is designed to a wrapped-front garment or a wrapped-back garment that is tied with ropes, which compromises patient privacy and may cause discomfort from coldness during the diagnosis or treatment process. Furthermore, patients with drainage of the lower limb need to be drained by a drainage tube and need to endure the pain of insertion and removal of the tube.

In order to solve the problem mentioned above, the inventor has invested in a lot of research, development, and effort in making breakthroughs and innovations, hoping to solve the current shortcomings with novel technical methods, not only bringing better products to the society, but also promoting industrial development at the same time.

SUMMARY OF THE INVENTION

In view of the aforementioned problems, the main purpose of the present invention is to provide a double-separating and double-pulling zipper, which has two sliders that can be opened and closed in a two-way manner. The zipper of the present application can be applied between two partitions of an office cubicle, homes, or any other required space. The zipper combines the two partitions together to achieve the effect of space separation. Moreover, the zipper of the present application has two sliders and can be applied to clothes and any objects suitable for sewing, which is convenient for users to open or close in two-way and achieve more purposes. Especially in the application of general patient gown, the double-separating and double-pulling zipper of the present invention can be made of plastic materials. As a result, patients can wear patient gown with the zipper made of plastic materials and undergo MRI examinations directly, maintaining their self-esteem during various examinations. In addition, patients undergo lower limb drainage, allowing the drainage tube to exit directly through the zipper. This eliminates the need for patients to endure the pain of inserting and removing the tube.

To achieve the above objective, the present invention provides a double-separating and double-pulling zipper comprising a left tape extension, a right tape extension, a first slider and a second slider. The left tape extension has a left zipper teeth row, a top insertion pin and a bottom insertion pin. The left zipper teeth row is arranged on an inner edge of the left tape extension, while the top insertion pin and the bottom insertion pin are respectively positioned at a top end and a bottom end of the left tape extension. Furthermore, the right tape extension has a right zipper teeth row, a top stop and a bottom stop. The right zipper teeth row is arranged on an inner edge of the right tape extension, while the top stop and the bottom stop are respectively positioned at a top end and a bottom end of the right tape extension. Moreover, the first slider has a first left pin box and a first right pin box, and the first left pin box is slidably arranged on the right zipper teeth row of the right tape extension. Also, the second slider has a second left pin box and a second right pin box. The second right pin box is slidably arranged on the right zipper teeth row of the right tape extension; and the second slider is positioned on the right zipper teeth row relative to the first slider. In addition, the top insertion pin of the left tape extension is inserted into the first right pin box of the first slider and fastened into the top stop; and the bottom insertion pin of the left tape extension is inserted into the second left pin box of the second slider and fastened into the bottom stop. Then, the first slider and the second slider are pulled so that the first slider and the second slider move along the left zipper teeth row and the right zipper teeth row. As a result, the left tape extension and the right tape extension are open or close simultaneously.

In some embodiments, there are a plurality of eyelets both on the left tape extension and the right tape extension, and the plurality of eyelets are inserted into corresponding holes on the left tape extension and the right tape extension.

To achieve the above further objective, the present invention provides a partition structure with a double-separating and double-pulling zipper, comprising a framework and a cover body; wherein the framework includes a top rack, two top hollow rods, a H-shaped rack, two bottom hollow rods, a bottom rack and a plurality of connecting tubes. The top rack, the two top hollow rods, the H-shaped rack, the two bottom hollow rods and the bottom rack are connected to each other through the connecting tubes. Furthermore, the cover body is placed over an outer surface of the framework. At least one side of the cover body is equipped with the aforementioned double-separating and double-pulling zipper, and a left tape extension and a right tape extension of the zipper are positioned either on the same side or on different sides of the cover body. Additionally, the bottom of the cover body is attached using a one-way zipper. Moreover, a first slider and a second slider are moved along the left zipper teeth row and the right zipper teeth row, so that the left tape extension and the right tape extension are opened or closed to combine the two adjacent partition structure.

In some embodiments, there are a plurality of eyelets both on the left tape extension and the right tape extension, and the plurality of eyelets are inserted into corresponding holes on the left tape extension and the right tape extension.

In some embodiments, an opening is created between the left zipper teeth row and the right zipper teeth row, allowing an object to be installed through the opening when the left zipper teeth row and the right zipper teeth row are partially open.

In some embodiments, the top rack, the two top hollow rods, the H-shaped rack, the two bottom hollow rods and the bottom rack are a plurality of hollow tubes, and when the connecting tubes are inserted into the top rack, the two top hollow rods, the H-shaped rack, the two bottom hollow rods and the bottom rack, the ends of the plurality of hollow tubes are abutted on a protruding ring formed on an outer surface of each connecting tube.

In some embodiments, each hollow tube has at least one concave holes, and each connecting tube has two concave rooves arranged on both sides of the protruding ring and surround the outer peripheral surface of each connecting tube, so that at least one concave hole is fastened to the two concave rooves.

To achieve the above further objective, the present invention provides a clothing with a double-separating and double-pulling zipper comprising a main part and a zipper. The zipper is the aforementioned double-separating and double-pulling zipper, which is arranged on the main part. Furthermore, a top insertion pin on a left tape extension is inserted into a first right pin box of a first slider and fastened into a top stop, and a bottom insertion pin on the left tape extension is inserted into a second left pin box of a second slider and fastened into a bottom stop. Then, the first slider and the second slider are pulled so that the first slider and the second slider move along the left zipper teeth row and the right zipper teeth row. As a result, the left tape extension and the right tape extension are opened or closed simultaneously. In addition, an opening is created between the left zipper teeth row and the right zipper teeth row, allowing an object to be installed through from the opening when the left zipper teeth row and the right zipper teeth row are partially open.

In some embodiments, the main body includes a torso covering, a limb covering, a glove, a sock, a shoe or a hat.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The above and other objects, features, and other advantages of the present invention will be more clearly understood from the following detailed description taken in conjunction with the accompanying drawings, in which.

DETAILED DESCRIPTION OF THE PREFERRED EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
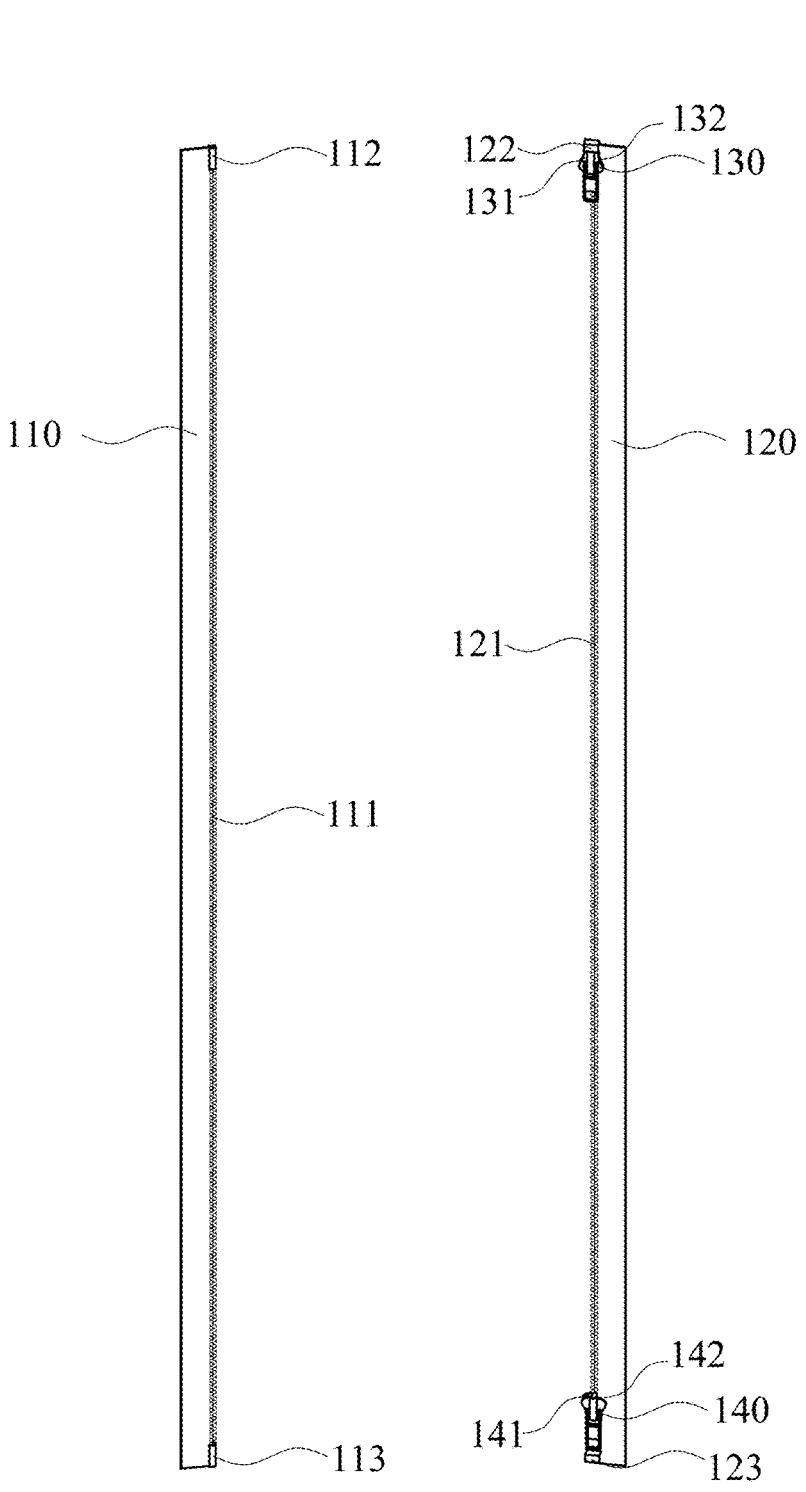
FIG. 1 is a schematic view of a double-separating and double-pulling zipper according to a first embodiment of the present disclosure.

Please refer to FIG. 1, FIG. 1 is a schematic view of a double-separating and double-pulling zipper according to a first embodiment of the present disclosure.

As shown in FIG. 1, the present invention provides a double-separating and double-pulling zipper 1 comprising a left tape extension 110, a right tape extension 120, a first slider 130 and a second slider 140; wherein the double-separating and double-pulling zipper 1 can be applied to No. 3, No. 4, No. 5, No. 7, No. 8 and No. 10 zippers made of metal, nylon and plastic steel zippers. First, the left tape extension 110 has a left zipper teeth row 111, a top insertion pin 112 and a bottom insertion pin 113. The left zipper teeth row 111 are arranged on an inner edge of the left tape extension 110, while the top insertion pin 112 and the bottom insertion pin 113 are respectively positioned at a top end and a bottom end of the left tape extension 110. Furthermore, the right tape extension 120 has a right zipper teeth row 121, a top stop 122 and a bottom stop 123. The right zipper teeth row 121 are arranged on an inner edge of the right tape extension 120, while the top stop122 and the bottom stop123 are respectively positioned at a top end and a bottom end of the right tape extension 120. Moreover, the first slider 130 has a first left pin box 131 and a first right pin box 132, and the first left pin box 131 is slidably arranged on the right zipper teeth row 121 of the right tape extension 120. In addition, the second slider 140 has a second left pin box 141 and a second right pin box 142, the second right pin box 142 is slidably arranged on the right zipper teeth row 121 of the right tape extension 120, and the second slider 140 is arranged on the right zipper teeth row 121 relative to the first slider 130. The top insertion pin 112 of the left tape extension 110 is inserted into the first right left pin box 131 of the first slider 130 and fastened into the top stop 122; and the bottom insertion pin 113 of the left tape extension 110 is inserted into the second left pin box 141 of the second slider 140 and fastened into the bottom stop 123. Further, the first slider 130 and the second slider 140 are pulled so that the first slider 130 and the second slider 140 move along the left zipper teeth row 111 and the right zipper teeth row 121, and the left tape extension 110 and the right tape extension 120 are opened or closed simultaneously.

Figures 2A, 2B:
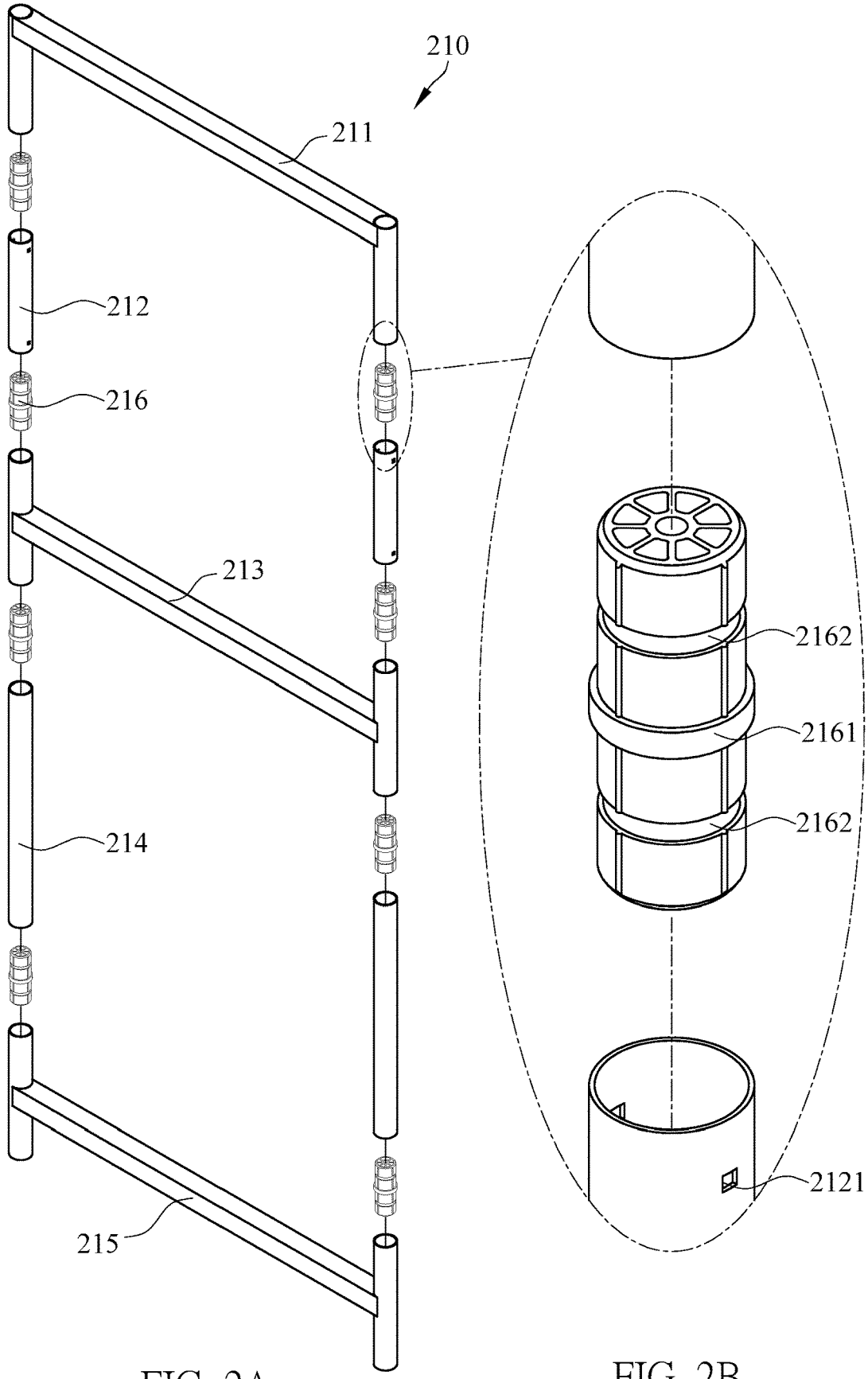
FIG. 2A is a schematic view of a framework of a partition structure according to a second embodiment of the present disclosure.
FIG. 2B is an exploded view of the framework of the partition structure according to the second embodiment of the present disclosure.
Figure 3:
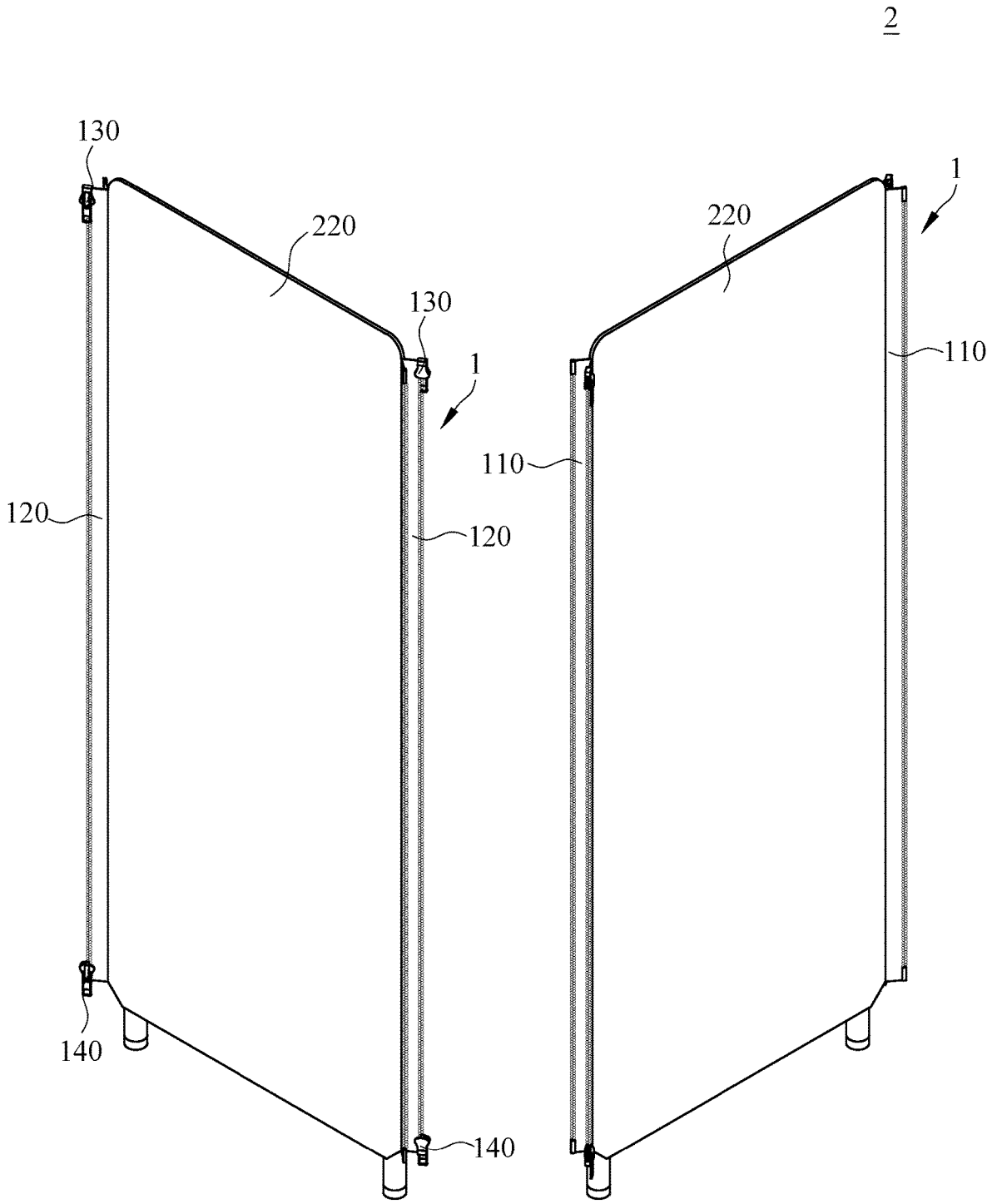
FIG. 3 is a schematic view of the partition structure according to the second embodiment of the present disclosure.

Please refer to FIG. 2A to FIG. 3, FIG. 2A is a schematic view of a framework of a partition structure according to a second embodiment of the present disclosure; FIG. 2B is an exploded view of the framework of the partition structure according to the second embodiment of the present disclosure; and FIG. 3 is a schematic view of the partition structure according to the second embodiment of the present disclosure.

As shown in FIG. 2A to FIG. 3, a structure of Embodiment 2 is substantially the same as the double-separating and double-pulling zipper described in Embodiment 1, except that a partition structure of Embodiment 2 applies the zipper of Embodiment 1. Embodiment 2 provides a partition structure 2 with the double-separating and double-pulling zipper, comprising a framework 210 and a cover body 220; wherein the framework 210 includes a top rack 211, two top hollow rods 212, a H-shaped rack 213, two bottom hollow rods 214, a bottom rack 215 and a plurality of connecting tubes 216, and the top rack 211, the two top hollow rods 212, the H-shaped rack 213, the two bottom hollow rods 214 and the bottom rack 215 are connected to each other through the connecting tubes 216. Furthermore, the cover body 220 is covered on an outer surface of the framework 210, at least one side of the cover body 220 has the above-mentioned double-separating and double-pulling zipper 1, and a left tape extension 110 and a right tape extension 120 of the zipper 1 are positioned either on the same side or on different sides of the cover body 220. Additionally, the bottom of the cover body 220 is attached using a one-way zipper. Moreover, a first slider 130 and a second slider 140 are moved along the left zipper teeth row 111 and the right zipper teeth row 121, so that the left tape extension 110 and the right tape extension 120 are opened or closed to combine the two adjacent partition structure 2. Furthermore, the top rack 211, the two top hollow rods 212, the H-shaped rack 213, the two bottom hollow rods 214 and the bottom rack 215 are a plurality of hollow tubes, and when the connecting tubes 216 are inserted into the top rack 211, the two top hollow rods 212, the H-shaped rack 213, the two bottom hollow rods 214 and the bottom rack 215, the ends of the plurality of hollow tubes are abutted on a protruding ring 2161 formed on an outer surface of each connecting tube 216. Moreover, each hollow tube has at least one concavehole 2121, and each connecting tube 216 has two concavegrooves 2162 arranged on both sides of the protruding ring 2161 and surround the outer peripheral surface of each connecting tube 216, so that at least one concave hole 2121 is fastened to the two concavegrooves 2162. The framework 210 of the partition structure 2 with a double-separating and double-pulling zipper of the present invention is made of hollow tubes, which reduces the weight of the entire partition structure. The framework 210 is connected through the plurality of connecting tubes 216, so that the framework 210 can be easily disassembled and conveniently stored. Furthermore, the cover body 220 can be easily removed from the framework 210 for storage, and the cover body 220 is made of cloth for easy cleaning; wherein the cloth is made of a polyester fiber material, a pure cotton material or a hemp material. The cover body 220 can also be made of waterproof material to achieve antifouling effect.

Figure 4A:
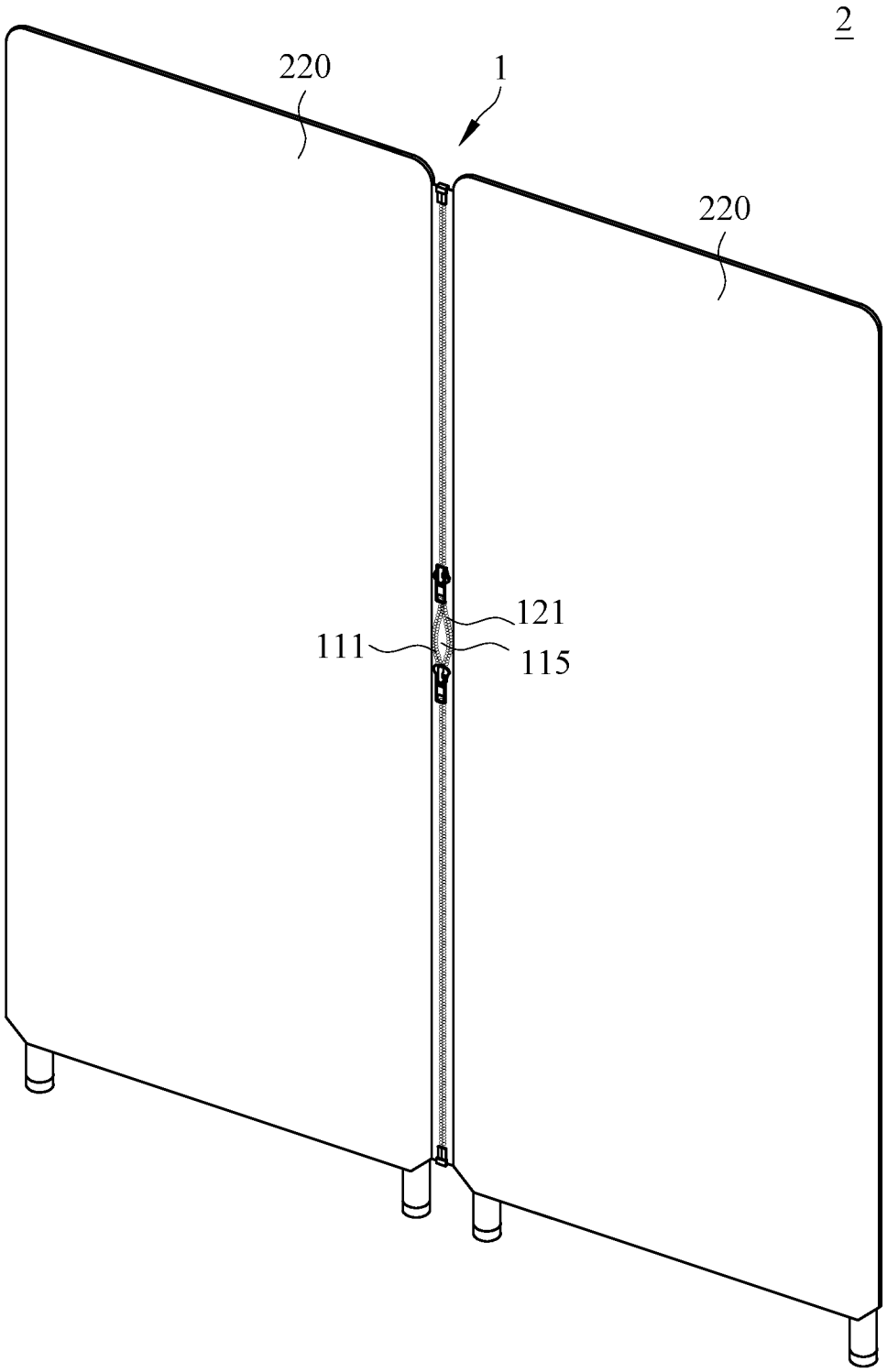
FIG. 4A is a schematic view of the partition structure according to a third embodiment of the present disclosure.

Please refer to FIG. 4A, FIG. 4A is a schematic view of the partition structure according to a third embodiment of the present disclosure.

As shown in FIG. 4A, the structure of Embodiment 3 is substantially the same as the double-separating and double-pulling zipper described in Embodiment 2, except that in embodiment 3, an opening 115 is created between the left zipper teeth row 111 and the right zipper teeth row 121, allowing an object to be installed through the opening 115 when the left zipper teeth row 111 and the right zipper teeth row 121 are partially open. For example, the partition structure 2 with double-separating and double-pulling zipper can divide an interior into separate rooms, and the electrical wiring installation in the separate rooms can be connected from the outside through the opening 115, and a position of the opening 115 can be adjusted freely without being restricted by objects. Moreover, the user can also install an electronic product into the separate rooms divided by the partition structure 2 and the electrical wiring of the electronic product is installed through the opening 115; wherein the electronic product may be randomly varied based on the user's requirements, such as a computer or a projector.

Figure 4B:
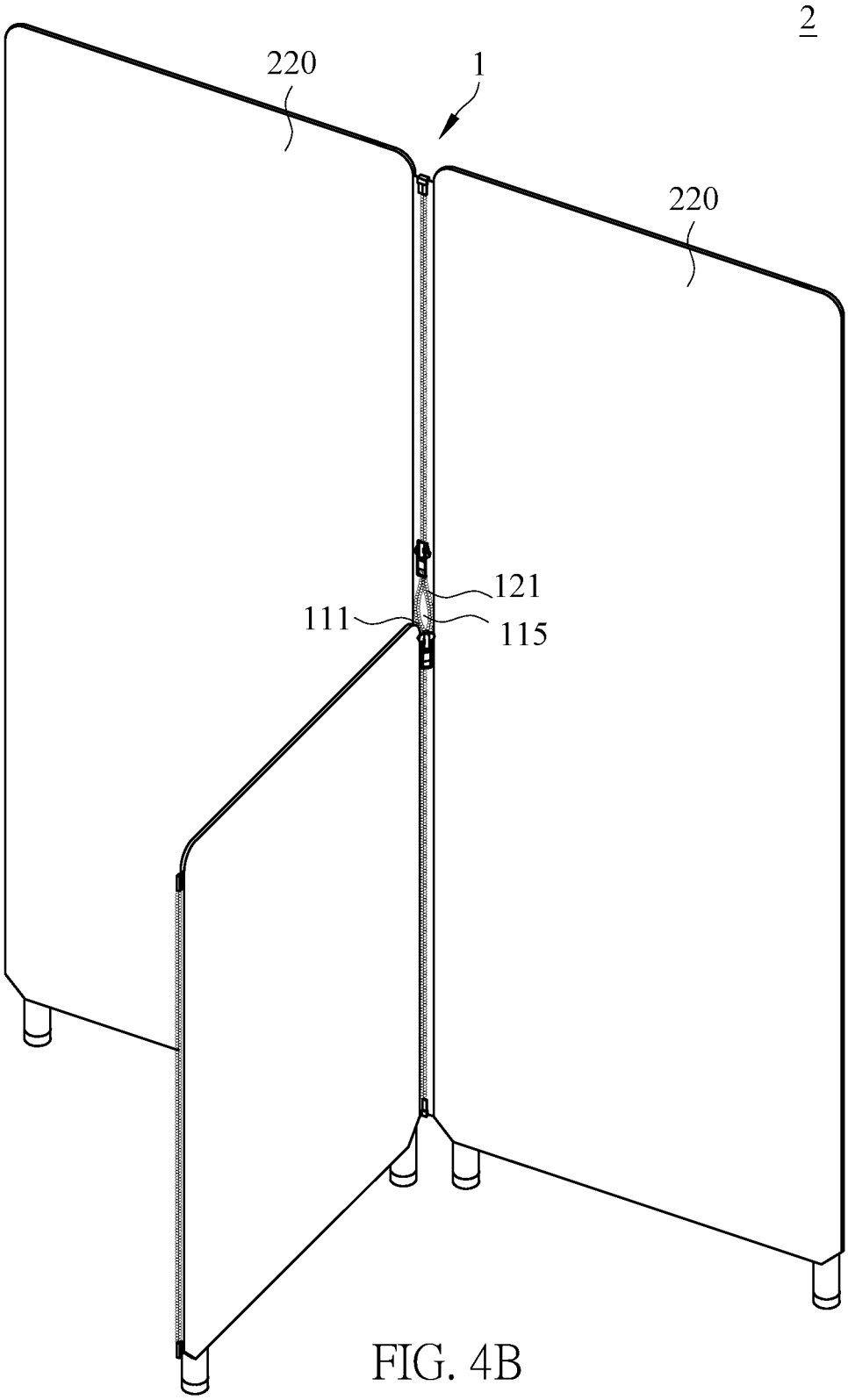
FIG. 4B is a schematic view of the partition structure according to a fourth embodiment of the present disclosure.

Please refer to FIG. 4B, FIG. 4B is a schematic view of the partition structure according to a fourth embodiment of the present disclosure.

As shown in FIG. 4B, the structure of Embodiment 4 is substantially the same as the partition structure described in Embodiment 3, except that the partition structures 2 of Embodiment 4 have different sizes. In order to meet different needs, the double-separating and double-pulling zipper 1 can be used to connect different sizes of the partition structure 2 with double-separating and double-pulling zippers, and an additional room can be easily divided for meetings, discussions or work. In addition, the partition structure 2 with double-separating and double-pulling zipper of the present invention has a lightweight design, making it easy to move and store. Further, an opening 115 is created between the left zipper teeth row 111 and the right zipper teeth row 121, allowing an object to be installed through the opening 115 when the left zipper teeth row 111 and the right zipper teeth row 121 are partially open. The opening 115 is created near an end of a shorter partition structure 2 due to the different heights of the partition structure 2.

Figure 5A:
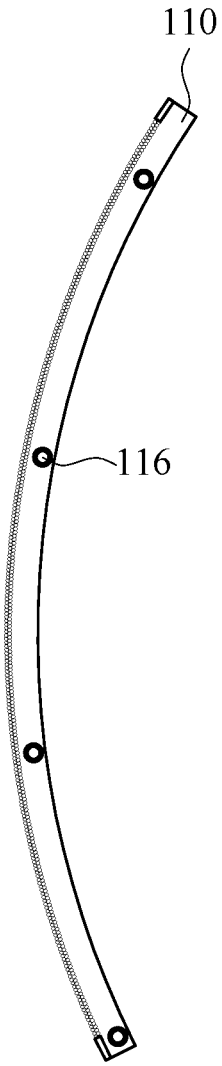
FIG. 5A is a schematic view of the double-separating and double-pulling zipper according to a fifth embodiment of the present disclosure.
Figure 5B:
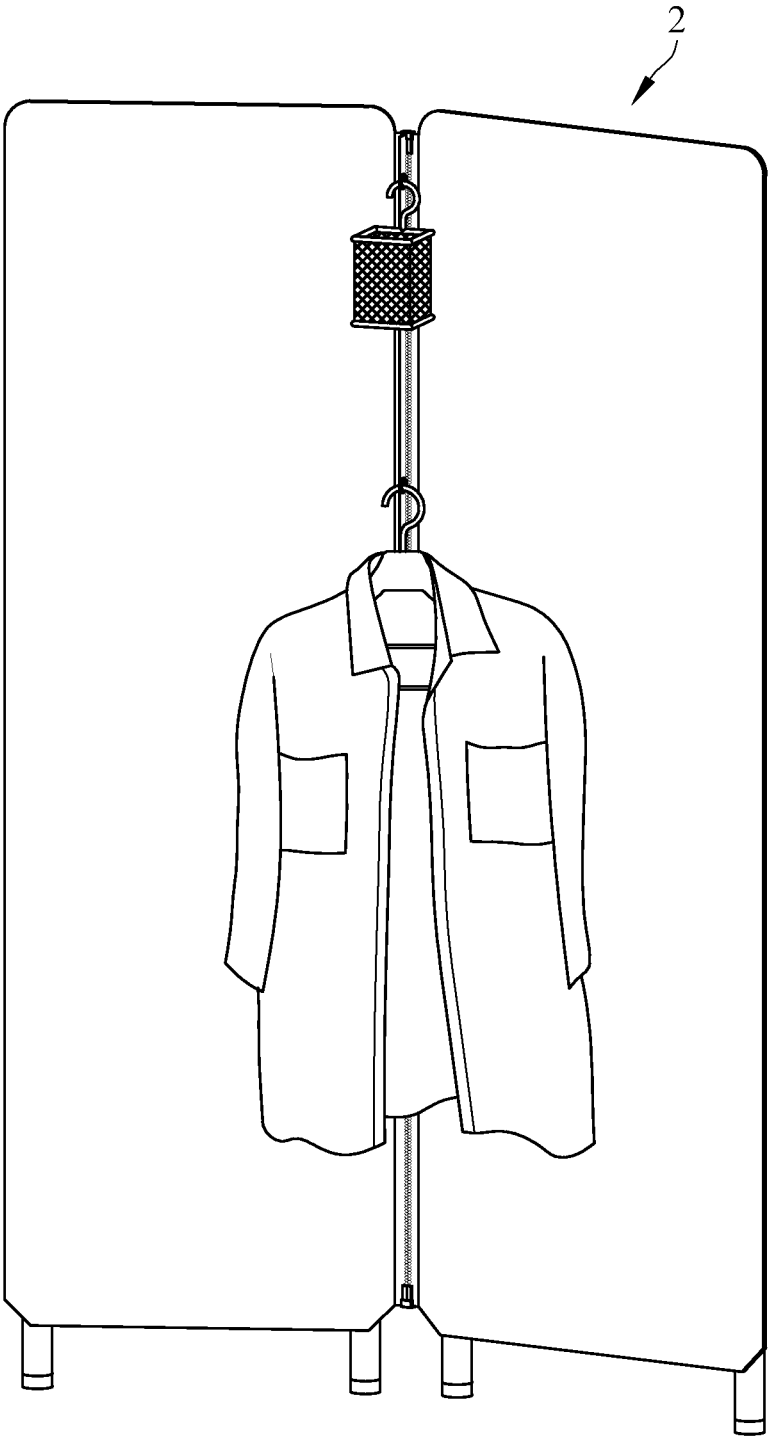
FIG. 5B is a schematic view of the partition structure according to a sixth embodiment of the present disclosure.

Please refer to FIGS. 5A and 5B, FIG. 5A is a schematic view of the double-separating and double-pulling zipper according to a fifth embodiment of the present disclosure; and FIG. 5B is a schematic view of the partition structure according to a sixth embodiment of the present disclosure.

As shown in FIG. 5A, the structure of Embodiment 5 is substantially the same as the double-separating and double-pulling zipper described in Embodiment 1, except that there is a plurality of eyelets 116 on the left tape extension 110 and the right tape extension 120, and the plurality of eyelets 116 are inserted into corresponding holes on the left tape extension 110 and the right tape extension 120. As shown in FIG. 5B, Embodiment 6 of the present invention is an application of Embodiment 5. When the partition structure 2 divides the interior into separate rooms, the required office stationery or daily necessities can be hung through the eyelets 116, which enables efficient use of space and enables multifunctional applications of the partition structure 2.

Figure 6:
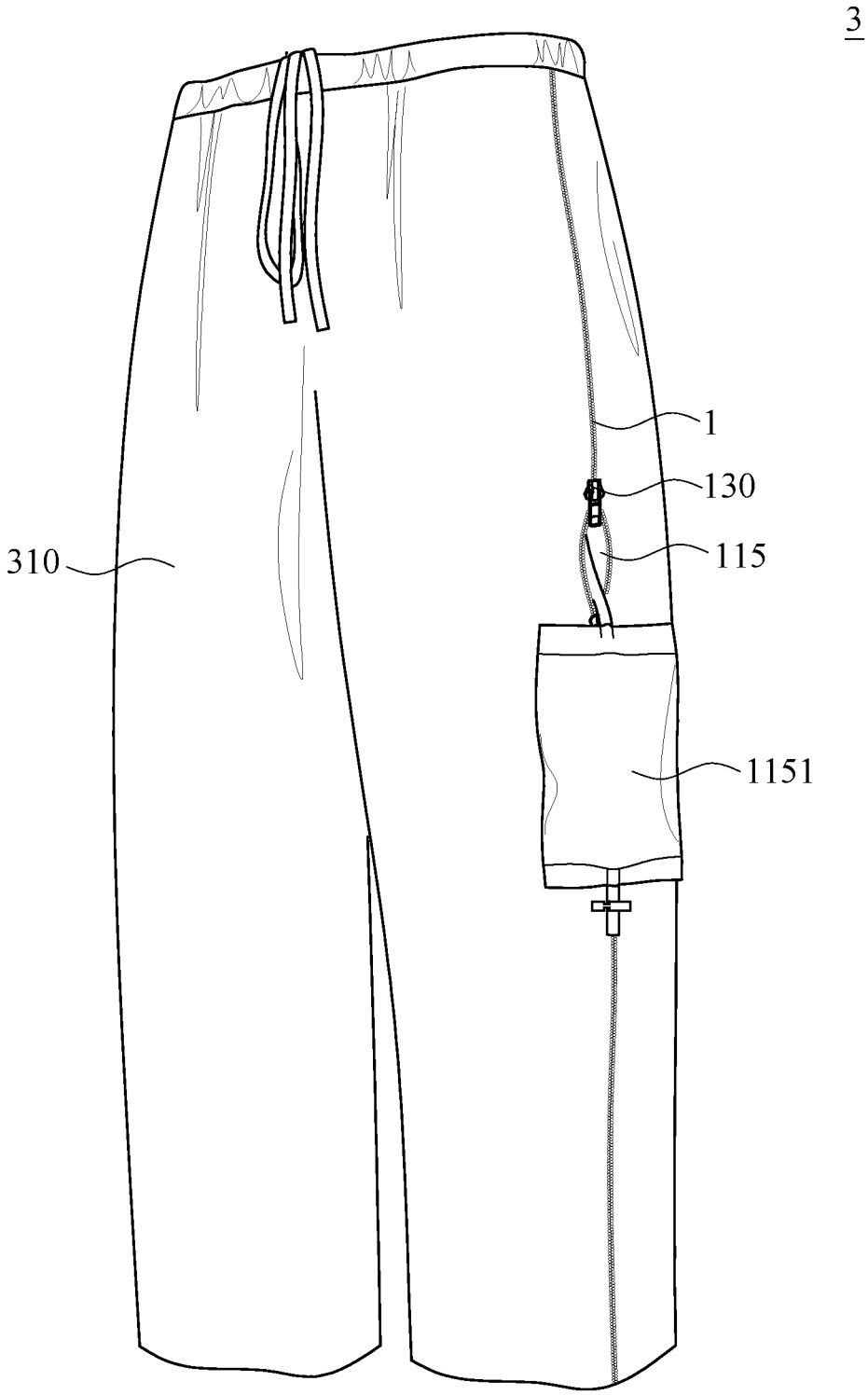
FIG. 6 is a schematic view of a clothing according to a seventh embodiment of the present disclosure.

Please refer to FIG. 6, FIG. 6 is a schematic view of a clothing according to a seventh embodiment of the present disclosure. As shown in FIG. 1 and FIG. 6, the seventh embodiment of the present invention provides a clothing 3 with a double-separating and double-pulling zipper comprising a main part 310 and a zipper 1. The zipper, mentioned above as a double-separating and double-pulling zipper, is arranged on the main part 310; wherein the main part 310 includes a torso cover, a limb cover, a glove, a sock, a shoe or a hat. Furthermore, a top insertion pin 112 on a left tape extension 110 is inserted into a first right pin box 132 of a first slider 130 and fastened into a top stop 122, and a bottom insertion pin 113 on the left tape extension 110 is inserted into a second left pin box 141 of a second slider 140 and fastened into a bottom stop 123. Moreover, the first slider 130 and the second slider 140 are pulled so that the first slider 130 and the second slider 140 move along the left zipper teeth row 111 and the right zipper teeth row 121, and the left tape extension 110 and the right tape extension 120 are opened or closed simultaneously. In addition, an opening 115 is created between the left zipper teeth row 111 and the right zipper teeth row 121, allowing an object to be installed through the opening 115 when the left zipper teeth row 111 and the right zipper teeth row 121 are partially open. In the seventh embodiment, the object 1151 is a urinary drainage bag, which is required by many patients to assist in the excretion of urine. Usually, the caregiver will use paper tapes or catheter fixing belts to secure a catheter on the patient's highs, but the aforementioned methods are likely to cause redness, itching, skin damage and the formation of skin indentations, which significantly affect the patient's comfort. If the trousers are equipped with the zipper 1 of the present invention, the urinary drainage bag can be easily extended from the inside of the trousers to the outside, eliminating the need to secure the urinary drainage bag on the patient's thigh and preventing discomfort to the patient. Furthermore, the zipper 1 can also be applied to general patient gowns. Since the patient gowns are equipped with multiple zippers to meet different needs, the zipper 1 can be opened or closed in a two-way manner to cater to the diverse requirements of patient gowns. This helps reduce the number of zippers and alleviate the pressure or discomfort caused by zippers on patients.

The foregoing description, for the purpose of explanation, has been described with reference to specific embodiments; however, the embodiments were chosen and described in order to best explain the principles of the disclosure and its practical applications, to thereby enable others skilled in the art to best utilize the disclosure and various embodiments with various modifications as are suited to the particular use contemplated. The embodiments depicted above and the appended drawings are exemplary and are not intended to be exhaustive or to limit the scope of the disclosure to the precise forms disclosed. Modifications and variations are possible in view of the above demonstrations.

I claim:

1. A partition structure with a double-separating and double-pulling zipper, comprising:

a framework including a top rack, two top hollow rods, an H-shaped rack, two bottom hollow rods, a bottom rack and a plurality of connecting tubes, and the top rack, the two top hollow rods, the H-shaped rack, the two bottom hollow rods and the bottom rack being connected to each other through the connecting tubes;

a cover body covering an outer surface of the framework, at least one side of the cover body having a zipper comprising a left tape extension and a right tape extension, the left tape extension having a left zipper teeth row, a top insertion pin, and a bottom insertion pin, and the right tape extension having a right zipper teeth row, a top stop, and a bottom stop, wherein the top insertion pin and the bottom insertion pin are respectively positioned at a top end and a bottom end of the left tape extension, and the top stop and the bottom stop are respectively positioned at a top end and a bottom end of the right tape extension;

a first slider having a first left pin box and a first right pin box, the first right pin box arranged slidably on the right zipper teeth row of the right tape extension;

a second slider having a second left pin box and a second right pin box, the second right pin box arranged slidably on the right zipper teeth row of the right tape extension and arranged relative to the first slider;

wherein the top insertion pin of the left tape extension is inserted into the first left right pin box of the first slider and fastened into the top stop, and the bottom insertion pin of the left tape extension is inserted into the second left pin box of the second slider and fastened into the bottom stop;

wherein the first slider and the second slider are pulled so that the first slider and the second slider move along the left zipper teeth row and the right zipper teeth row, and the left tape extension and the right tape extension are opened or closed simultaneously; and wherein each of the hollow rods of the framework has at least one concave hole, and each of the connecting tubes has two concave grooves arranged on sides of a protruding ring formed on an outer peripheral surface of each of the connecting tubes so that the at least one concave hole is fastened to one of the two concave grooves.

* * * * *